US007249691B2

(12) United States Patent
Doogan

(10) Patent No.: US 7,249,691 B2
(45) Date of Patent: Jul. 31, 2007

(54) PRODUCT EXTRACTOR FOR VALVE BAGS

(75) Inventor: Raymond Paul Doogan, Orland Park, IL (US)

(73) Assignee: Corn Products International, Inc., Westchester, IL (US)

( * ) Notice: Subject to any disclaimer, the term of this patent is extended or adjusted under 35 U.S.C. 154(b) by 450 days.

(21) Appl. No.: 10/975,805

(22) Filed: Oct. 28, 2004

(65) Prior Publication Data

US 2006/0054637 A1 Mar. 16, 2006

Related U.S. Application Data

(60) Provisional application No. 60/515,722, filed on Oct. 29, 2003.

(51) Int. Cl.
*B67D 5/06* (2006.01)

(52) U.S. Cl. ..... 222/105; 222/1; 222/181.2; 222/181.3; 222/152; 222/167; 141/65; 141/114; 141/319; 414/403; 414/416.03; 414/419

(58) Field of Classification Search ..... 222/95, 222/105; 141/319, 320; 414/419
See application file for complete search history.

(56) References Cited

U.S. PATENT DOCUMENTS

| | | | | |
|---|---|---|---|---|
| 4,550,755 | A | 11/1985 | Vredenburg, Sr. | |
| 4,574,851 | A | 3/1986 | Lepisto | |
| 4,627,781 | A | 12/1986 | Borgner | |
| 5,111,854 | A | 5/1992 | Begley et al. | |
| 5,573,044 | A * | 11/1996 | Mechalas | 141/83 |
| 5,682,929 | A | 11/1997 | Maginot et al. | |
| 5,927,552 | A | 7/1999 | Toshima | |
| 5,975,351 | A | 11/1999 | DeLacerda | |
| 6,227,408 | B1 * | 5/2001 | Poulton | 222/1 |
| 6,254,330 | B1 | 7/2001 | Steffen et al. | |
| 7,168,460 | B2 * | 1/2007 | Dietrich et al. | 141/10 |
| 2003/0006248 | A1 | 1/2003 | Gill et al. | |
| 2005/0199650 | A1 * | 9/2005 | Nyhof et al. | 222/105 |
| 2006/0110242 | A1 * | 5/2006 | Pfeiffer et al. | 414/412 |

* cited by examiner

*Primary Examiner*—J. Casimer Jacyna
(74) *Attorney, Agent, or Firm*—Norris, McLaughlin & Marcus

(57) ABSTRACT

The invention pertains to a device for removing the contents of a valve bag using suction. The invention further pertains to a method of removing the contents of a valve bag using the device.

19 Claims, 5 Drawing Sheets

PRODUCT EXTRACTOR FOR VALVE BAGS

CROSS REFERENCE TO RELATED APPLICATION

This application claims the benefit of U.S. Provisional Application 60/515,722 filed Oct. 29, 2003.

BACKGROUND OF THE INVENTION

1. Field of the Invention

The invention pertains to a device that uses suction to remove the contents from valve bags. The device comprises a bag support having flaps that hold the bag. A suction piece is inserted into the valve opening of the valve bag and the valve bag is rotated up to about 180° so that the valve opening is in a downward position. Suction draws product out of the bag. In this manner, the valve bag can be emptied without ripping the bag and product dusting is eliminated during product removal. The invention also pertains to a method for removing the contents of a valve bag by using suction.

2. The Related Art

Particulate materials are commonly packaged in bags that are made from multiple layers of paper and have a valve and valve opening in one upper corner. The valve provides an opening through which the material is dispensed during the bag filling operation. The valve bag is typically filled by inserting a spout or nozzle into the valve and causing material to flow through the nozzle into the bag. When the bag is full, the flow of material is halted and the nozzle is withdrawn from the valve usually by moving the bag away from the nozzle. The valve is closed to prevent egress of the material from the bag during shipping and handling. U.S. Pat. No. 4,550,755 describes a bag filling machine for valve bags.

The general method for removing the contents of a valve bag is to cut the bag and physically remove the contents of the bag through the cut opening. A bag cutting device is described in U.S. Pat. No. 4,627,781. Cutting the bag may undesirably result in contamination of the bag contents with non soluble residue fibers from the bag. Thus, a method for extracting product from valve bags that does not require cutting the valve bag would be welcomed in the art.

A system for using a siphoning nozzle to remove the contents from upright bulk bags is described in U.S. Pat. No. 5,975,351. U.S. Pat. No. 5,682,929 describes a system for the multiple filling and emptying of a receptacle with pourable product. The bags described in U.S. Pat. No. 5,682,929 have openings on the bottom for removing product from the bag with a suction hose wherein the discharging device has agitating fingers. U.S. Published Patent Application No. U.S. 2003/0006248 describes the use of a vacuum to remove the contents from a bulk bag to a hopper.

We have developed a device and method for efficiently removing the contents of a valve bag, preferably a bag having one valve opening, without requiring the undesirable ripping of the bag and unwanted dusting while removing product from the bag. The method and device uses flaps to secure the valve bag and a suction piece is inserted into the valve opening. The device rotates the valve bag up to about 180° and can rotate the valve bag as much as about 360°, so that the valve opening is pointing downward. Suction is used to remove the contents of the valve bag.

When the valve opening is in a downward position, the contents of the valve bag move towards the valve opening. This prevents significant aeration of the contents within the valve bag during removal, inhibits plug flow at the valve opening and prevents the bag materials from blocking the nozzle at the valve opening during the removal. Also, because the material within the valve bag flows downward during content removal, the valve bag during the operation collapses on the upper edge of the moving material, opposite to the valve opening, which results in a substantially collapsed bag after the removal process facilitating removal from the apparatus and disposal or recycling.

SUMMARY OF THE INVENTION

The invention pertains to a device and a method for removing product from a valve bag using the device. The device and method involves the use of suction to withdraw product from an inverted valve bag.

The device comprises a bag stand that is capable of rotating around an axis. The device further comprises a suction piece that is capable of insertion into the valve opening of a valve bag. The suction piece is equipped with a means for suction that is used to remove the contents from a valve bag.

A valve bag is inserted into the bag stand and when the device is operated the bag stand is rotated up to about 180° thereby inverting, or substantially inverting, the valve bag. After the bag stand is rotated, the means for suction is activated which removes the contents from the valve bag. The device further comprises means for establishing the valve bag in a conical shape to facilitate flow of material out of the valve bag.

DETAILED DESCRIPTION OF THE DRAWINGS

DETAILED DESCRIPTION OF THE INVENTION

Figure 1:
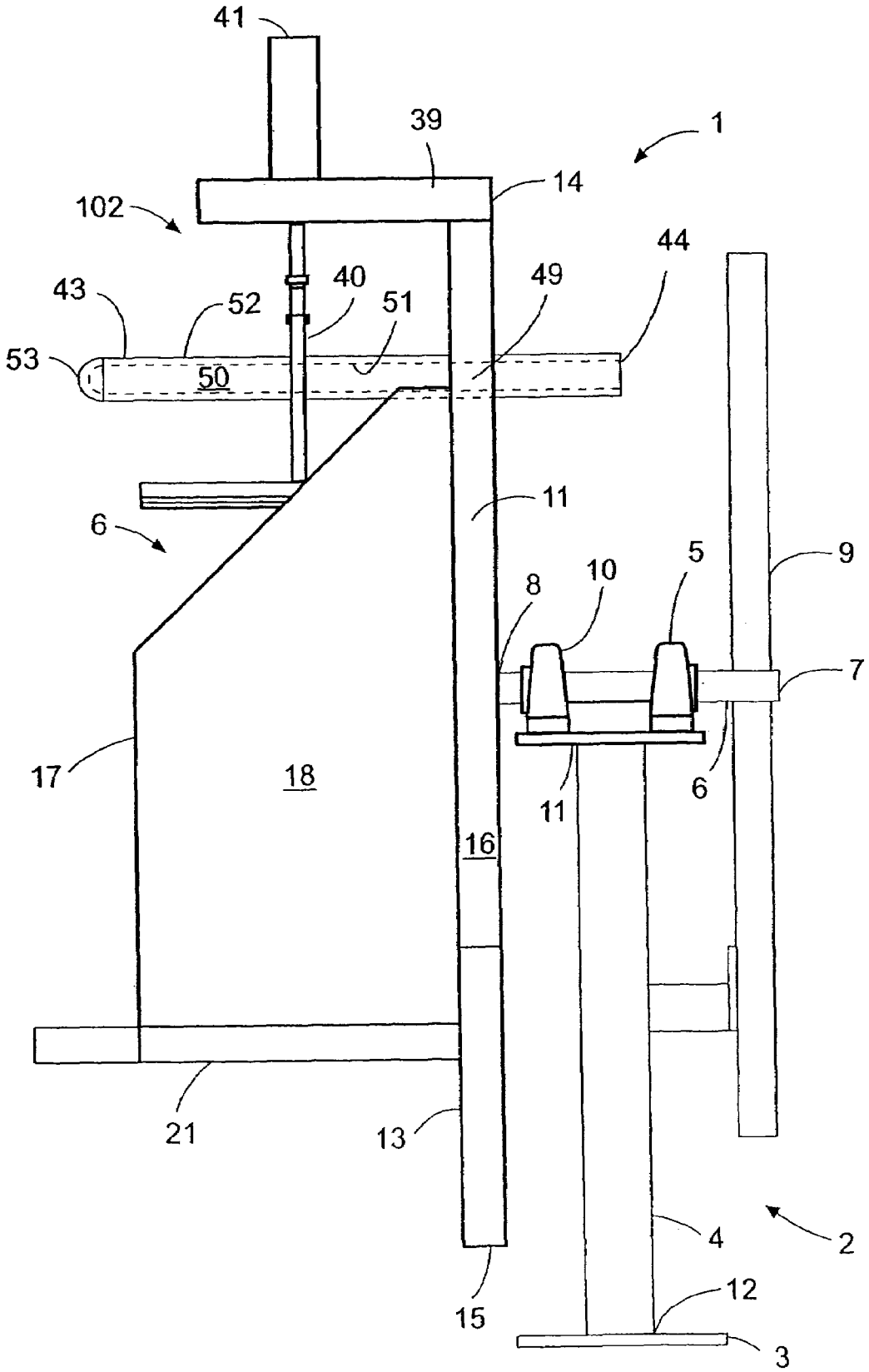
FIG. 1 is a side view of the device in accordance with an embodiment of the invention.

Referring to the FIG. 1, the device 1 comprises a stand 2 having a base 3, a vertical member 4 having a first end 11 and second end 12 and a rotator 5 having a rotator shaft 6. The rotator shaft 6 has a first end 7 and a second end 8 and is attached at the second end 8 to a bag support 102. The rotator 5 is activated by a means for actuating the rotator, such as an electric motor, which is connected to or part of the rotator. The stand 2 may, optionally, comprise a manual lever 9 which may function as the means for activating the rotator 5. The rotator 5 may also comprise a sleeve coupling 10 which may accommodate the rotator shaft 6. The sleeve coupling 10 may be a pillow bearing, such as a pillow block bearing. In the embodiment shown in FIG. 1, the sleeve coupling 10 is adjacent to the first end 11 of the vertical member 4 and the second end 12 of the vertical member 4 is adjacent to the base 3, and the rotator shaft 6 is attached approximate to the first end 7 to a manual lever 9 and at the second end 8 to a vertical support 13 of the bag support 102.

In this embodiment, the manual lever 9 can be physically rotated to invert the bag support 6.

Figure 2:
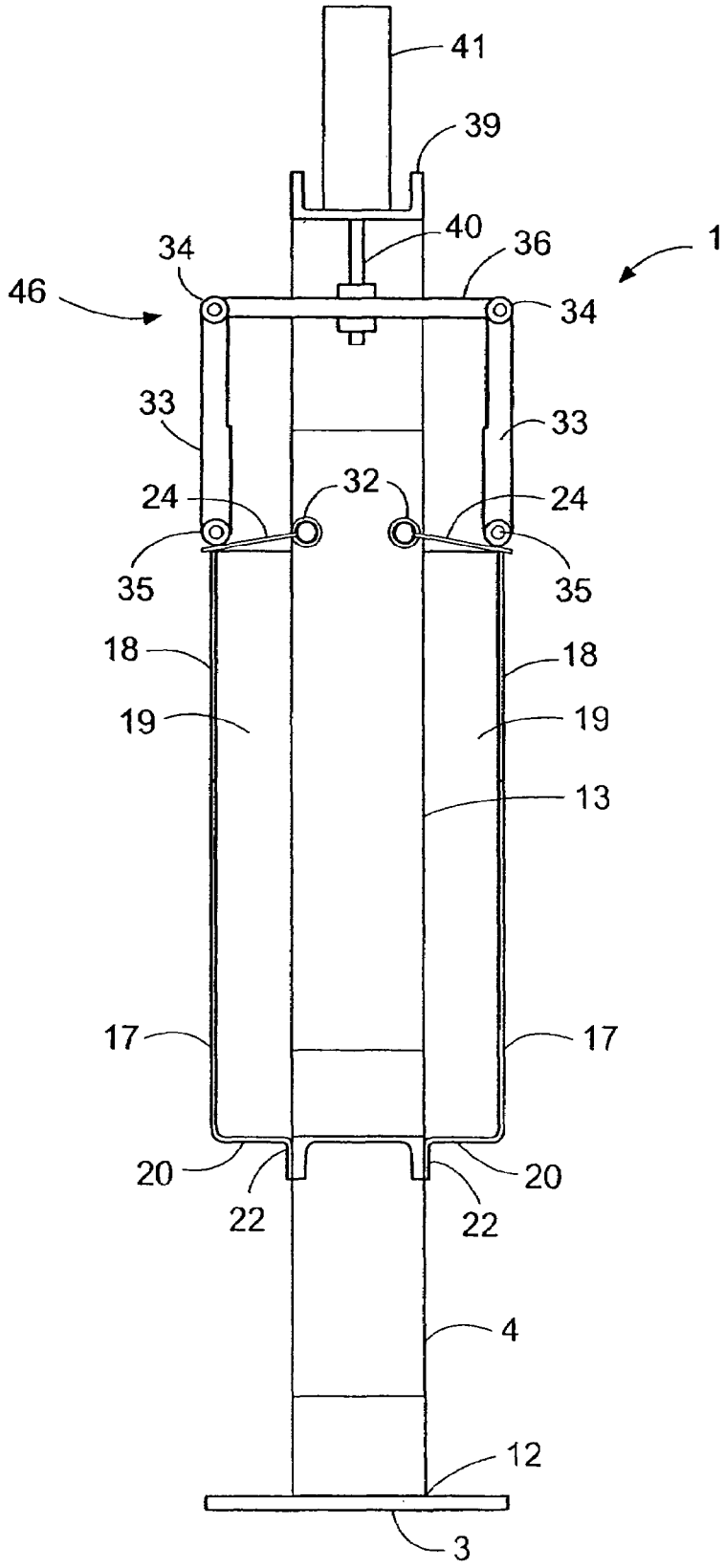
FIG. 2 is a front view of the device in accordance with an embodiment of the invention.
Figure 3:
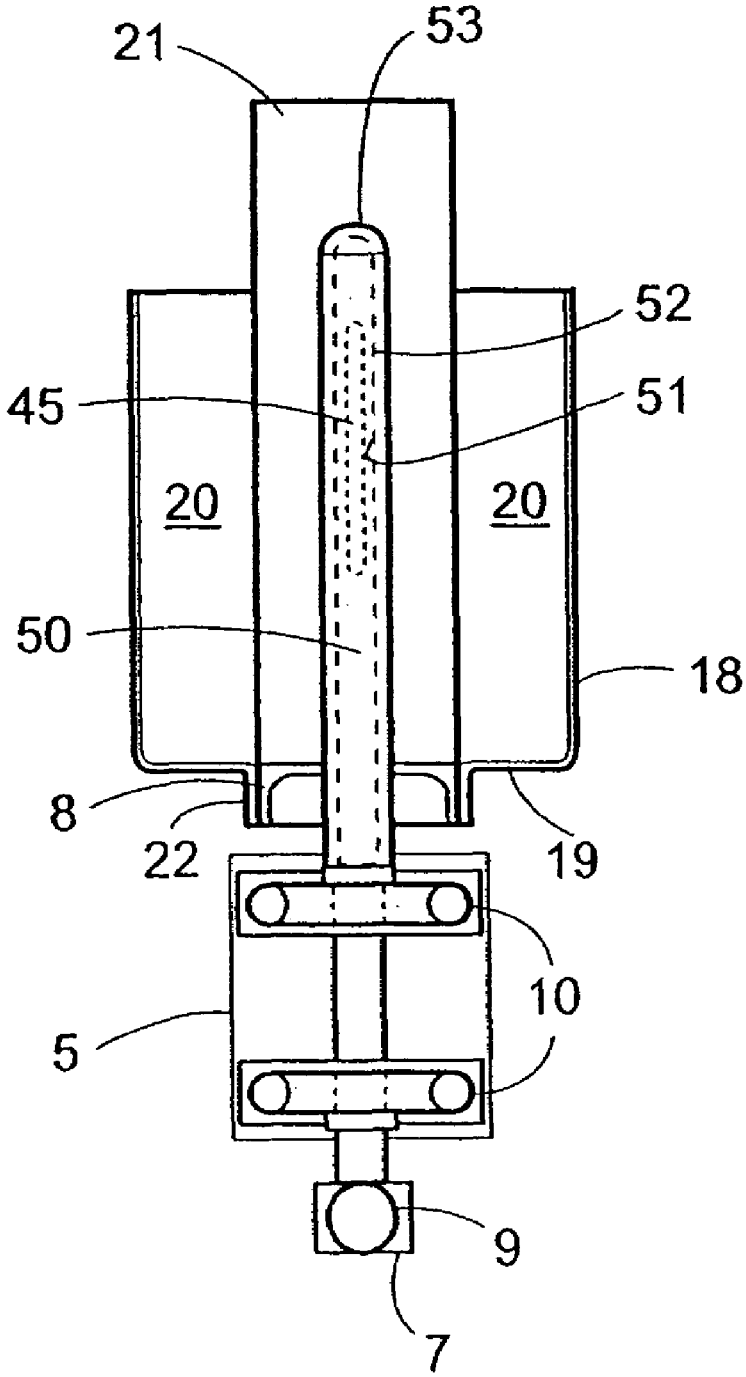
FIG. 3 is a top view of the device in accordance with an embodiment of the invention.

Referring to FIGS. 1-3, the bag support 102 generally comprises the vertical support 13 having an upper end 14, a lower end 15 and a body 16. The bag support 102 further comprises a pair of opposing side flanges 17 which are adjacent to the body 16 of the vertical support 8 at some point between the upper end 14 and lower end 15 of the body 16 of the vertical support 8. Each opposing side flange 17 may have an outer support wall 18 with a back support wall 19 adjacent to the outer support wall 18 and about perpendicular to the outer support wall 18. The back support wall 19 is generally a section of material that is adjacent to the outer support wall 18 and continues in a plane about vertical to the outer support wall to about the body of the vertical support 13. Each opposing side flange 17 further comprises a bottom support member 20 which is adjacent to a lower edge of each of the outer support walls and back support wall.

The bag support 102 also comprises a horizontal bag support member 21 which, as shown in FIG. 1, is about perpendicular to the vertical support 13 and protrudes opposite to the stand 2 from the body 16 of the vertical support, more proximate to the lower end 15 than the upper end 14. Each opposing side flange 17 has a fastening flange 22, which is shown in FIG. 2 as extending from about each bottom support member 20, such as at about a 90° angle from each bottom support member, and are proximate to the horizontal bag support member 21. The fastening flange 22 may, as shown in FIG. 5, be fastened to the horizontal bag support member by one or more first fastening means 23, such as nuts and bolts, rivets or welds.

As shown in the figures, particularly FIGS. 2-5, the bag support 102 may further comprise flaps 24 that are generally rectangular having four lateral edges, a first edge 25 and an opposing third edge 26 and a second edge 27 and an opposing fourth edge 28, each in the same horizontal plane with each edge about perpendicular to an adjoining edge. Each flap 24 also comprises an upper face 29 and a lower face 30. Each flap 24 at its first edge 25 is secured to or integral with a rotating section 31. The rotating section 31 is generally cylindrical and can be inserted into circular openings 32 in the vertical support 13 in such a manner that the rotating section 31 is capable of rotating within the circular opening. The rotating sections are free to move or pivot within the circular openings making the flaps capable of motion, e.g., rotation. The rotating sections may have freedom of rotational movement in a plane about vertical to the vertical support.

Figure 4:
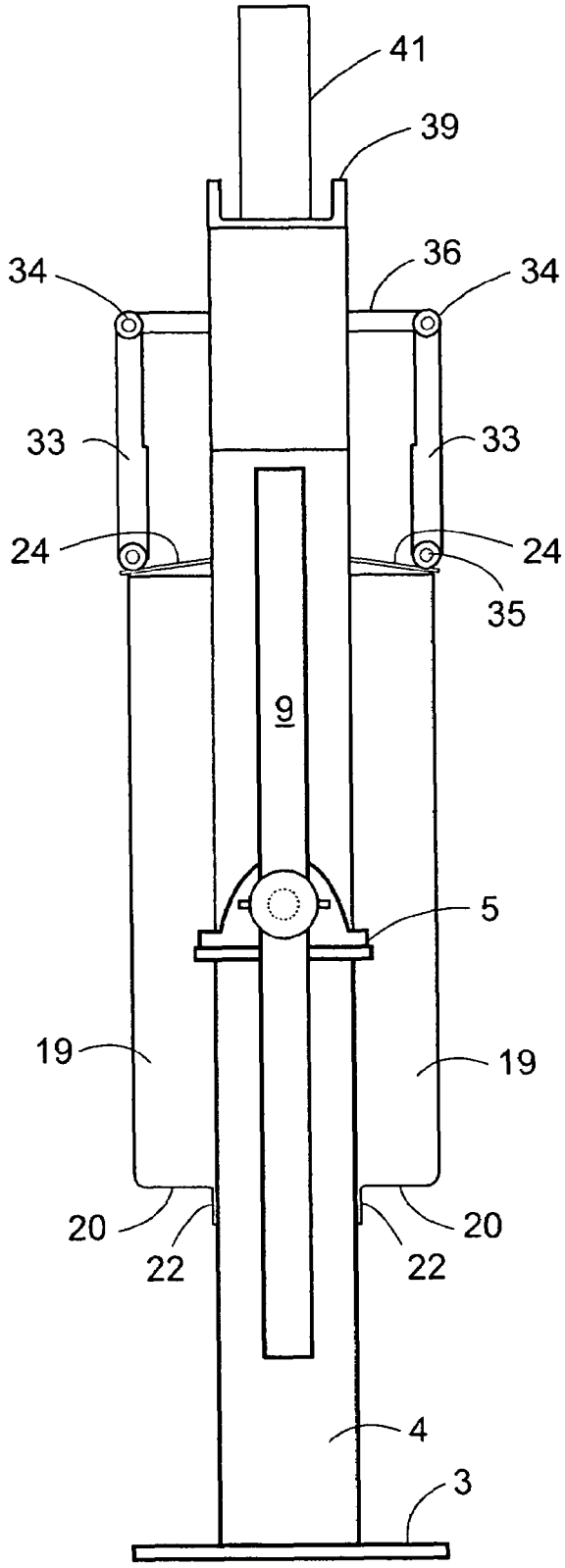
FIG. 4 is a back view of the device in accordance with an embodiment of the invention.
Figure 5:
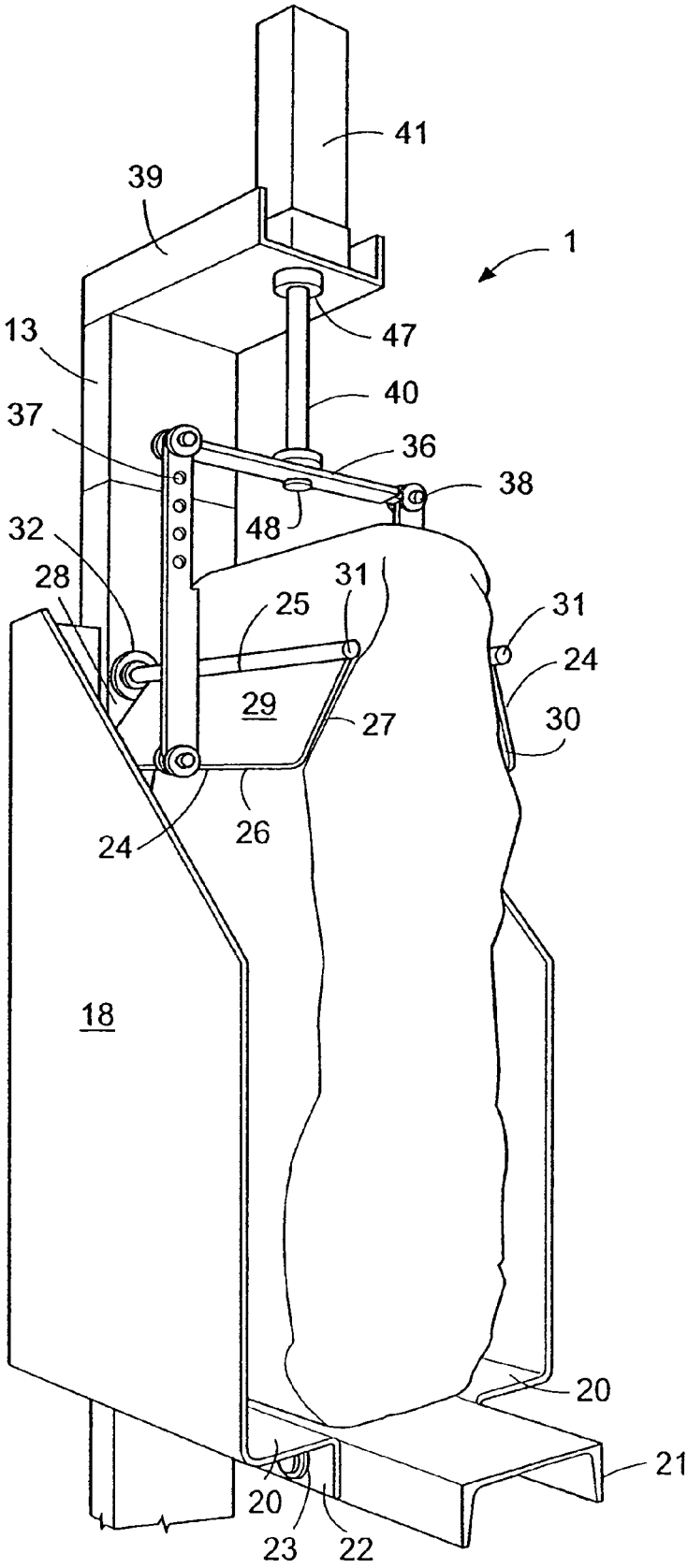
FIG. 5 is a perspective view of the device in accordance with an embodiment of the invention wherein the device is engaged with a valve bag.

As shown in the figures, particularly FIGS. 2, 4 and 5, the bag support may further comprise an adjustable support member 46 having a pair of opposing extension members 33, each having a first end 34 and a second end 35. The first end 34 of each of the extension members is releasably secured to a support bar 36, and at the second end 35 to the upper face 29 of each flap.

As shown in FIG. 5, each extension member may comprise one or more holes or openings 37. Each extension member 33 is releasably secured to the adjustable support member 46 by extension member securement means 38, which may be, for example, nuts and bolts or rods and pins, and the like. In practice, the pair of opposing extension members 33 can be releasably secured to the support member 32 in any of the holes or openings to allow a valve bag to be grasped or held in place by the flaps.

The bag support may, as shown in the figures, further comprise a cantilever top 39 which is attached to or integral with the vertical support 13 at about the upper end 14 and extends outward from the upper end of the vertical support at an angle of up to about 90° or more from the vertical support. In an embodiment of the invention as shown particularly in FIG. 5, the support bar 36 is secured to the cantilever top 39 by hanging means 40, such as a shaft of a pneumatic cylinder, rod, bar or other structural support piece. The hanging means 40 is located at about the center of the support bar 36. The hanging means 40 has a first end 47 and a second end 48 and is attached at its first end 47 to the cantilever top 39 and at its second end 48 to the support member 40 at about the center of the support member, e.g., about equidistant from each end of the support member.

In an embodiment of the invention, the device may comprise a pneumatic cylinder 41 that is positioned adjacent to the cantilever top 39. In this embodiment, the hanging means 40 is the shaft of the pneumatic cylinder 41. The shaft protrudes through a hole in the cantilever top 39. The pneumatic cylinder 41 is attached to a pneumatic device which uses air pressure to cause the hanging means 40, i.e. the shaft, to move vertically. This causes the flaps move while the rotating sections 31 rotate within the circular openings 32.

As shown in the figures, particularly FIGS. 1 and 3, the device further comprises a suction piece 43 having a pair of opposed ends and a continuous side wall having an inner surface 51 and an outer surface 52 wherein the inner surface defines a hollow conduit section or hollow conduit 50. The suction piece 43 has at one end an end opening 44, such that the hollow conduit at one end of the suction piece is partially or completely open, and the other end of the suction piece is a solid piece of material, such as a convex shaped cap 53, which facilitates insertion of the suction piece 43 into the valve opening of the valve bag. The suction piece further comprises a side wall opening 45, which, as shown as in FIG. 3, is generally located proximate to the end of the suction piece opposite to the end opening 44. The suction piece 43 is attached to the vertical support such that the side wall opening 45 is located on the side of the back support proximate to the flaps 24 with the end opening 44 located on the opposite side of the vertical support 13. The suction piece 43 is such that it runs through the body 16 of the vertical support 13, such as through a bore hole 49 or the like and is secured to the vertical support 13. Generally, the suction piece 43 can be inserted through the bore hole. The side wall opening 45 is preferably oriented such that the side wall opening 45 faces downward, e.g. opposite to the cantilever top 39. A means for suction (not shown) can be secured or releasably secured to the suction piece at the end opening 43. The means for suction may be a vacuum effect, such as the creation of pressure gradient having higher pressure at the end opening of the suction piece than in the valve bag.

In use, a valve bag, as shown in the figures, particularly FIG. 5, is placed with the suction piece inserted into the valve opening so that the side wall opening is inserted into the valve bag. Once the suction piece is inserted into the valve bag, the flaps are actuated by moving the extension members so that the extension members can be releasably secured to the support member in the appropriate hole that enables the flaps to rest on or grasp the valve bag and/or by use of the pneumatic cylinder. The flaps provide the bag with a conical shape in the area where the suction piece is inserted into the valve bag. This facilitates removal of product from the valve bag and prevents the bags from collapsing around this spot during product removal. The bag support, with the valve bag, is then rotated up to about 180° using the rotator so that the bag becomes inverted having the valve opening at the bottom of the device. The rotation can be done either automatically, such as with an electric motor, or manually using the manual lever. The means for suction, which should be secured or releasably secured to the suction piece prior to inserting the suction piece into the valve bag, is then activated to empty the bag. Preferably, the valve opening is releasably secured to the suction piece so that an air tight or substantially air tight connection is achieved. In this manner, the contents of the valve bag can be efficiently removed without product contamination, dust or waste and the bag collapses upon itself, such as on the upper edge of the material or contents of the valve bag moving within the interior of the valve bag during removal of the contents. This facilitates removal of the empty valve bag from the device, enables easier disposal or recycling of the valve bag, and provides efficient removal of product content from the valve bag with minimal product waste.

An embodiment of the invention involves a device for emptying the contents of a valve bag comprising a stand comprising a vertical member having a first end and a second end, a base at the second end of the vertical member and a rotator at the first end of the vertical member, the rotator comprising a rotator shaft; a bag support comprising a vertical support having an upper end, a lower end and a body; a pair of opposing side flanges each having an outer support wall, a back support wall, a bottom support wall and a fastening flange, the back support wall of each opposing side flange being adjacent to the body of the vertical support at a location between the upper end and the lower end; a horizontal bag support member which protrudes from the body of the vertical support about adjacent to the fastening flange of each opposing side wall flange with the fastening flange of each opposing side wall flange secured to the horizontal member by first fastening means; a suction piece having a pair of opposed ends and a continuous side wall having an inner surface and an outer surface wherein the inner surface of the side wall defines a hollow conduit and the inner surface at one end of the suction piece defines an end opening with the side wall having a side wall opening; and a means for suction releasably secured to the suction piece at the end opening. The rotator shaft has opposing first ends and second ends and the second end is attached to the body of the vertical support such that the bag support is capable of having rotational movement in a plane about parallel to the stand.

The invention also involves a method for removing the contents of a valve bag comprising the steps of providing a device having a means for suction, attaching a valve bag to the device by inserting the suction piece of the device into a valve of the valve bag so that an air tight or substantially air tight seal is established between the device and the contents of the valve bag, aligning the valve bag so that the valve into which the suction piece is inserted is in a downward position and removing the contents of the valve bag by suction. Particularly, the invention encompasses the method wherein the devices described in this application are used in the method.

What is claimed is:

1. A device for emptying the contents of a valve bag comprising a) a stand comprising a vertical member having a first end and a second end, a base at the second end of the vertical member and a rotator at the first end of the vertical member, the rotator comprising a rotator shaft;

b) a bag support comprising (i) a vertical support having an upper end, a lower end and a body;

(ii) a pair of opposing side flanges each having an outer support wall, a back support wall, a bottom support wall and a fastening flange, the back support wall of each opposing side flange being adjacent to the body of the vertical support at a location between the upper end and the lower end; and (iii) a horizontal member which protrudes from the body of the vertical support about adjacent to the fastening flange of each opposing side wall flange with the fastening flange of each opposing side wall flange secured to the horizontal member by first fastening means;

c) a suction piece having a pair of opposed ends and a continuous side wall having an inner surface and an outer surface wherein the inner surface of the side wall defines a hollow conduit and the inner surface at one end of the suction piece defines an end opening with the side wall having a side wall opening; and d) a means for suction releasably secured to the suction piece at the end opening;

wherein the rotator shaft has opposing first ends and second ends and the second end is attached to the body of the vertical support such that the bag support is capable of having rotational movement in a plane about parallel to the stand.

2. The device of claim 1 further comprising flaps having a first edge with an opposing third edge and a second edge with an opposing fourth edge and a pair of rotating sections protruding from the vertical support proximate to the upper terminus of the opposing side flanges with the first edge of each flap secured to or integral with a surface of the rotating sections with the rotating sections secured to the vertical support such that the rotating sections have freedom of rotational movement in a plane about vertical to vertical support.

3. The device of claim 2 further comprising a cantilever top having at least an upper surface, a lower surface, a first end and an opposing a second end, the second end attached to or integral with the upper end of the vertical support.

4. The device of claim 1 further comprising an adjustable support member having a pair of opposing extension members each having at least opposing first extension member ends and second extension member ends and a support bar having opposing first support bar ends and second support bar ends wherein a) the first extension member end of one of the opposing extension members is releasably secured to the support bar at the first support bar end and the first extension member end of the other opposing extension member is releasably secured to the support bar at the second support bar end by extension member securement means; and b) the second extension member end of each of the opposing extension members is fastened to the outer surface of separate flaps.

5. The device of claim 4 further comprising a pneumatic cylinder having a shaft.

6. The device of claim 4 wherein the extension members further comprise holes capable of accommodating the extension member securement means wherein the position of the extension members relative to the support bar is moveable.

7. The device of claim 1 further comprising a manual lever.

8. The device of claim 1 wherein the body of the vertical support further comprises a bore hole through which the suction piece is inserted.

9. The device of claim 8 wherein the suction piece is attached to the body of the vertical support at the bore hole.

10. The device of claim 1 further comprising means for suction.

11. The device of claim 10 wherein the means for suction creates a pressure gradient having higher pressure at the end opening of the suction piece than in the valve bag.

12. A method for removing the contents of a valve bag comprising the steps of a) providing the device of claim 1, b) providing a valve bag having a valve c) attaching the valve bag to the device by inserting the suction piece into the valve of the valve bag so that an air tight seal or substantially air tight seal is established between the device and the valve bag, d) aligning the valve bag so that the valve into which the suction piece is inserted is more proximate to the base of the device than the upper end of the vertical support, and e) removing the contents of the valve bag by suction.

13. The method of claim 12 wherein the valve bag is aligned by rotating the bag support up to about 180°.

14. The method of claim 12 wherein a means for suction is releasably attached to the end opening of the suction piece before the valve bag is attached to the device.

15. The method of claim 12 wherein the valve bag collapses on the upper edge of the contents moving within the valve bag during the step of removing the contents of the valve bag by suction.

16. The method of claim 15 wherein the valve bag is substantially collapsed after the step of removing the contents of the valve bag by suction.

17. The method of claim 12 wherein the device of claim 2 is used.

18. The method of claim 17 wherein the flaps cause the valve bag to have a conical shape in the area where the suction piece is inserted into the valve bag.

19. The method of claim 12 wherein the device of claim 6 is used.

* * * * *